US007310977B2

(12) United States Patent
Ueyama

(10) Patent No.: US 7,310,977 B2
(45) Date of Patent: Dec. 25, 2007

(54) SELECTION ACTUATOR FOR KNITTING MEMBER

(75) Inventor: Hiroyuki Ueyama, Wakayama (JP)

(73) Assignee: Shima Seiki Manufacturing, Ltd., Wakayama (JP)

( * ) Notice: Subject to any disclaimer, the term of this patent is extended or adjusted under 35 U.S.C. 154(b) by 0 days.

(21) Appl. No.: 10/594,219

(22) PCT Filed: Mar. 24, 2005

(86) PCT No.: PCT/JP2005/005403

§ 371 (c)(1),
(2), (4) Date: Sep. 26, 2006

(87) PCT Pub. No.: WO2005/098116

PCT Pub. Date: Oct. 20, 2005

(65) Prior Publication Data

US 2007/0193308 A1 Aug. 23, 2007

(30) Foreign Application Priority Data

Mar. 30, 2004 (JP) ..... 2004-098562

(51) Int. Cl.
*D04B 15/32* (2006.01)

(52) U.S. Cl. ..... 66/219

(58) Field of Classification Search ..... 66/75.2, 66/218–221, 232, 75.1
See application file for complete search history.

(56) References Cited

U.S. PATENT DOCUMENTS 3,605,448 A * 9/1971 Ribler ..... 66/220
4,715,198 A * 12/1987 Ploppa et al. ..... 66/75.2
4,989,424 A * 2/1991 Furia ..... 66/219
5,802,878 A * 9/1998 Nakamori et al. ..... 66/64
5,819,559 A * 10/1998 Nakamori et al. ..... 66/232
6,584,810 B2 * 7/2003 Nakahata et al. ..... 66/75.2
6,651,464 B2 * 11/2003 Ueyama ..... 66/219

FOREIGN PATENT DOCUMENTS

| | | | |
|---|---|---|---|
| EP | 474195 | A2 | 3/1992 |
| JP | 54-21466 | B2 | 7/1979 |
| JP | 5-321102 | A | 12/1993 |
| JP | 9-111621 | A | 4/1997 |
| JP | 2878166 | B2 | 4/1999 |
| JP | 11-176655 | A | 7/1999 |
| WO | WO 01/75202 | A1 | 10/2001 |
| WO | WO 02/18690 | A1 | 3/2002 |

* cited by examiner

*Primary Examiner*—Danny Worrell
(74) *Attorney, Agent, or Firm*—Rothwell, Figg, Ernst & Manbeck

(57) ABSTRACT

A plurality of control magnetic poles 33*n*-34*n* are provided in each selection unit of a selection actuator, and the upstream control magnetic poles 33*n, s* and downstream control magnetic poles 34*n, s* are controlled independently based on the relative positions thereof to selectors. The selectors can be selected with a pitch approximately half the pitch at which selection is possible with the conventional selection actuator and the time used for selecting each selector can be extended. Therefore, a knitting member can be reliably selected even in a fine-gauge knitting machine.

8 Claims, 10 Drawing Sheets

SELECTION ACTUATOR FOR KNITTING MEMBER

CROSS REFERENCE TO RELATED APPLICATION

This application is a 35 USC §371 National Phase Entry Application from PCT/JP2005/005403, filed Mar. 24, 2005, and designating the United States.

TECHNICAL FIELD

The present invention relates to an actuator for selecting a knitting member such as a needle or loop transferring member in a flat knitting machine or circular knitting machine.

BACKGROUND ART

In a flat knitting machine or circular knitting machine, a knitting member such as a needle is selected with a selection actuator, and the selected needle is driven with a carriage cam. A problem associated with the selection actuators is how to make them compatible with fine-gauge knitting machines. A gauge of a knitting machine represents a number of needles per 1 inch, and with a fine gauge, the knitting members have to be selected with a small pitch.

International patent application WO02/18690 describes that a non-magnetic body is inserted between a control magnetic pole (a magnetic pole for controlling the magnetization state in a coil and using it for selecting a knitting member) and a fixed magnetic pole (a magnetic pole that is magnetized in a fixed state, for example, with a permanent magnet), and a leakage magnetic flux from the fixed magnetic pole is prevented from penetrating into the control magnetic pole. This application also discloses that coils of control magnetic poles are used to bypass the gap between the fixed magnetic poles and to form a magnetic circuit from the permanent magnet via the fixed magnetic pole and coil to the fixed magnetic pole and permanent magnet on the opposite side. Japanese Patent No. 2878166 and European Patent No. EP0474195B disclose a configuration in which a plurality of control magnetic poles are provided in one selection unit, but they do not describe the control thereof.

Where a fine-gauge knitting machine is employed, the thickness of knitting members is also reduced and the time that can be used for selecting individual knitting members is shortened. As a result, the knitting members are difficult to select.

DISCLOSURE OF THE INVENTION

Objects of the Invention

It is a main object of the present invention to enable the reliable selection of fine-gauge knitting members.

Another object of the present invention is to enable the arrangement of coils and magnetic cores of a plurality of control magnetic poles inside a selection actuator.

Yet another object of the present invention is to prevent the saturation of magnetic core magnetization and reduce iron loss.

Yet another object of the present invention is to decrease the variation of magnetic resistance depending on whether or not a knitting member is attracted by the control magnetic poles and to enable demagnetization regardless of whether or not the knitting member is attracted.

Yet another object of the present invention is to prevent residual magnetization from accumulating in the selector.

Solution by the Invention

The present invention provides a selection actuator in which a plurality of control magnetic poles controlled with coils are disposed close to each other on the upstream side and downstream side and a knitting member of a knitting machine is selected by the control magnetic poles, wherein control means is provided for controlling independently the control magnetic poles on the upstream side and the control magnetic poles on the downstream side based on the position of the knitting member that is the selection object. The knitting machine is, for example, a flat knitting machine, and the present invention is applicable to flat knitting machines and circular knitting machines with a fine gauge of, for example, 20 G (gauge) or higher. The knitting member is, for example, a needle, but may also be a loop transferring member.

It is preferred that a width in which the knitting member be selected by any of the upstream control magnetic poles and downstream control magnetic poles is 80% or more, more preferably 100% or more of an arrangement pitch of the knitting members in the knitting machine, when calculated as a range of positions of the knitting members with respect to the control magnetic poles. For example, if the knitting machine is a flat knitting machine and the gauge is 25 G, then the arrangement pitch of knitting members is approximately 1 mm and the selection is conducted over a range in which the relative position of the knitting member and selection actuator moves through 0.8 mm or more, preferably 1 mm or more.

It is also preferred that the magnetic cores of the upstream and downstream control magnetic poles have linear shapes, the coils be wound about the magnetic cores, and the upper sections of the magnetic cores be bent along the longitudinal direction of the selection actuator so that the distal ends of the magnetic cores face each other via a short spacing and serve as the upstream and downstream control magnetic poles.

It is especially preferred that the magnetic cores comprise laminates of a plurality of oriented silicon steel strips, the thickness of the control magnetic poles be made less than the thickness of magnetic cores inside the coils by reducing the number of laminated silicon steel strips in the portions of the control magnetic poles, and the width of the control magnetic poles in the short-side direction of the selection actuator be made larger than the width of the magnetic cores inside the coils in the same direction.

Further, it is preferred that a gap be provided between a N pole and a S pole of each of the control magnetic poles, and the position of the gap be shifted along the short-side direction of the selection actuator in the upstream control magnetic poles and the downstream control magnetic poles.

Furthermore, it is preferred that magnetic attraction of the knitting member by the control magnetic poles be canceled and the knitting member be released from the selection actuator by energizing the coils, left and right fixed magnetic poles be disposed along the longitudinal direction of the selection actuator on both outer sides of the upstream control magnetic poles and downstream control magnetic poles, and the polarities of the left and right fixed magnetic poles be inverted with respect to each other.

Advantages in the Invention

In accordance with the present invention, the control magnetic poles are independently controlled based on the position of a knitting member on the upstream side and downstream side. Therefore, the width of the range where the selection of the knitting member is performed can be enlarged and the interval in which the selection is performed can be extended, and a knitting member can be reliably selected even in the case of a fine gauge. For example, in accordance with the present invention, a knitting member can be selected with a pitch of 80% or more, preferably 100% or more of the arrangement pitch of knitting members, when calculated as the range where the selection of the knitting member is performed. By contrast, when independent control magnetic poles are used, the width in which selection is conducted is limited to 100% of the arrangement pitch of knitting members, even at the upper theoretical limit, and because no gap is present between the selections of the former and subsequent knitting members at 100%, the practical upper limit is less than 80%, for example, 70% or less.

Here, if the magnetic cores have a linear shape, the upper sections thereof are bent, and the distal ends of magnetic cores are arranged to face each other on the upstream side and downstream side, then a plurality of control magnetic poles can be arranged with a short spacing and the coils also can be accommodated inside the selection actuator.

If the magnetic cores are made from oriented silicon steel strips, the iron loss is small and saturation of magnetization hardly occurs. Furthermore, if the number of oriented silicon steel strips is less in the portion of control magnetic poles than inside the coil, then the saturation of magnetization will hardly occur inside the coils. Moreover, if the width of the magnetic core is less than the width of the control magnetic pole, then the magnetic core can be readily accommodated inside the coil. The number of oriented silicon steel strips is, for example, 1-4 in a control magnetic pole and 2-8 in the coil section.

If a gap is provided between a N pole and a S pole of a control magnetic pole and the positions of the gaps of the control magnetic poles on the upstream side and downstream side are shifted with respect each other, a magnetic circuit bypassing the gap can be obtained with the neighboring control magnetic poles. Therefore, the variation of magnetic resistance depending on whether the knitting member is attracted to the control magnetic pole is decreased, and a uniform degree of magnetization of control magnetic pole can be obtained even when the knitting member is attracted.

If a residual magnetization accumulates in a knitting member, it produces a negative effect on selection with the selection actuator. In particular, the characteristic of release from the control magnetic pole is degraded. However, if the polarities in the left and right fixed magnetic poles are inverted, then the residual magnetization that was accumulated in the selector as it passed by one fixed magnetic pole can be eliminated by the other fixed magnetic pole and the accumulation of residual magnetization can be prevented.

The problem of the magnetic resistance of control magnetic poles varying depending on whether or not the knitting member is attracted and the problem of the release characteristic being degraded by residual magnetization are aggravated with the transition to a fine gauge in knitting machines. Furthermore, the shape and material of magnetic cores make it possible to realize small coils and small control magnetic poles that can be easily assembled with the selection actuator and to perform accurate selection of knitting members.

DESCRIPTION OF THE SYMBOLS

| | | | |
|---|---|---|---|
| 2 | selection actuator | 4 | working portion |
| 6 | needle | 7 | needle jack |
| 8 | selector jack | 10 | selector |
| 12 | bat | 14 | elastic leg |
| 16 | armature | 18 | needle bed |
| 20 | carriage | 21,22 | band |
| 30 | first selection unit | 32 | second selection unit |
| 33 | first control magnetic pole | 34 | second control magnetic pole |
| 35,36 | coil | 38 | nonmagnetic body |
| 40~43 | permanent magnet | 44~49 | magnetic body |
| 50 | magnetic core | 52 | permanent magnet |
| 54,56 | gap | 60 | control unit |
| 62 | upstream selection width | 64 | downstream selection width |
| 65,66 | overlapping portion | 70,80,90 | selection actuator |
| 75 | gap | 73n~74s | control magnetic pole |
| 83n~85s | control magnetic pole | 93n~95s | control magnetic pole |
| 87,96 | coil | p | selector serving as an object |
| f | previous selector | r | following selector |
| s1,s2 | selection signal | PHASE | signal |

EMBODIMENTS

The best mode for carrying out the invention will be described below.

Best Embodiment

Figure 6:
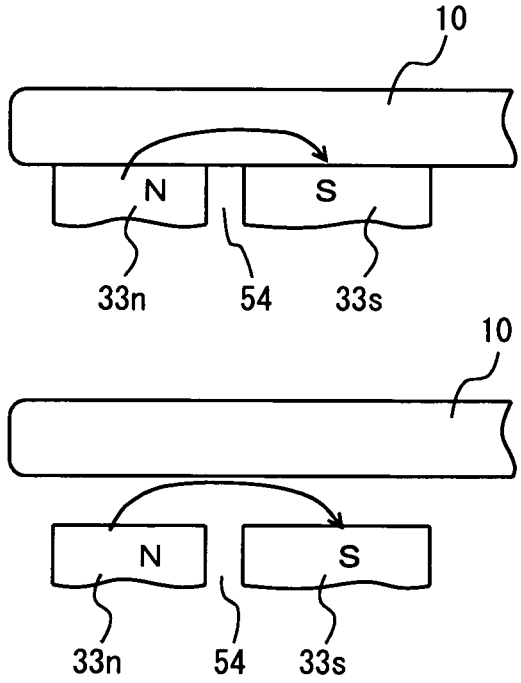
FIG. 6 shows schematically the variation of magnetic resistance when the selector comes into contact with the demagnetized control magnetic pole and when the selector is separated therefrom.
Figure 7:
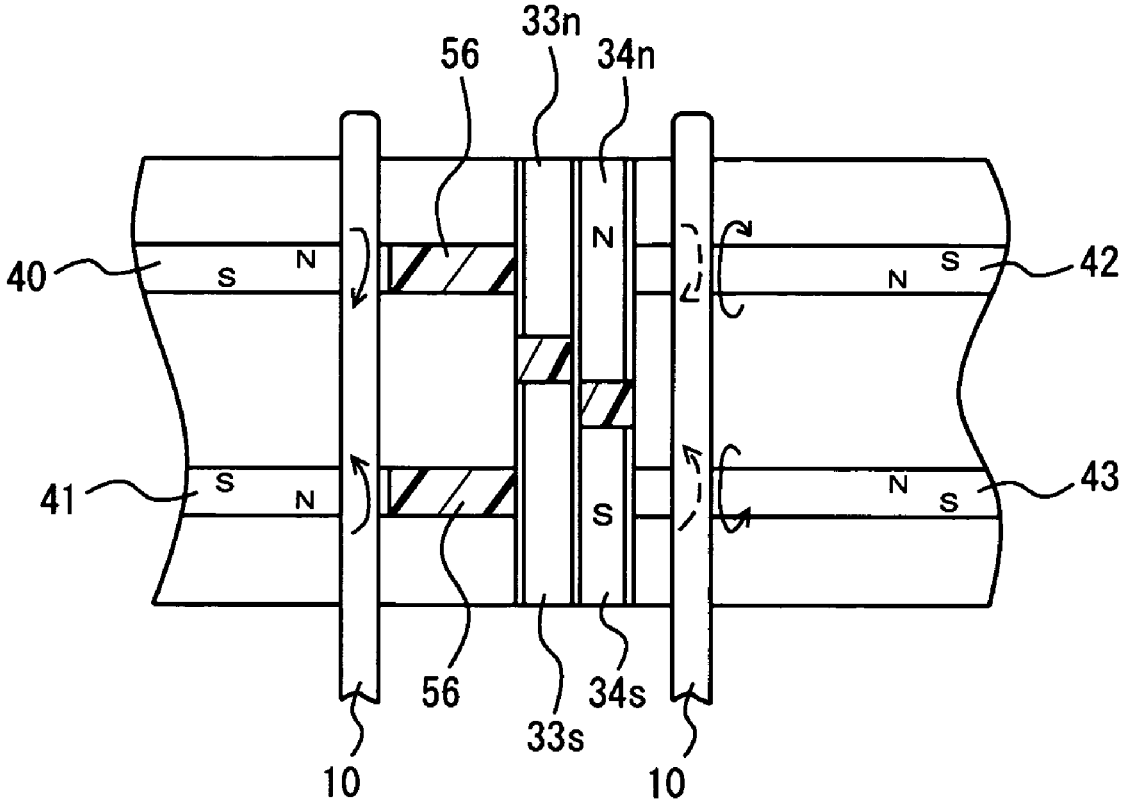
FIG. 7 shows schematically how the accumulation of residual magnetization in a selector is prevented by inverting the polarity of fixed magnetic poles on both sides of the control magnetic pole.
Figure 8:
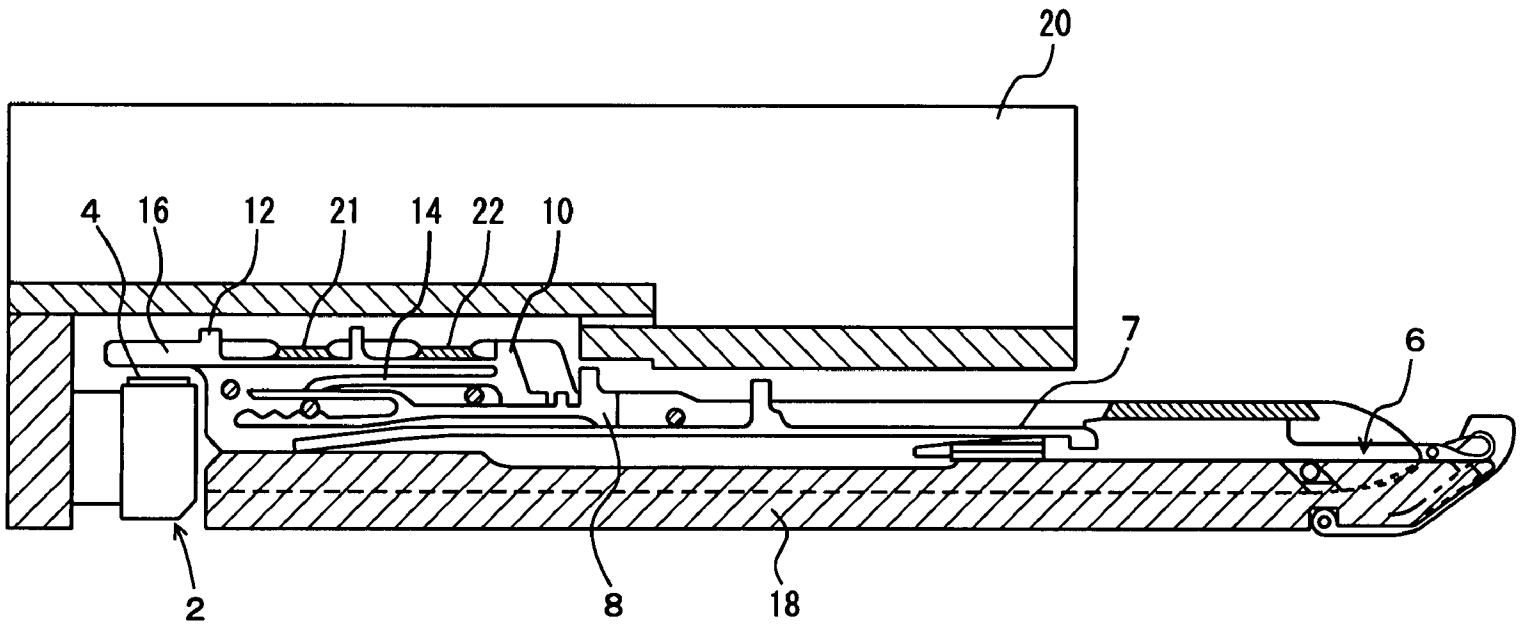
FIG. 8 is a main sectional view of a flat knitting machine illustrating the arraignment of needle selector and selection actuator.

FIG. 1 to FIG. 11 illustrate a selection actuator 2 of the present embodiment and modifications thereof. A working portion 4 is present on the upper surface of the selection actuator 2 and serves to select a selector of a needle of a flat knitting machine and to make a selection of a needle operated by the carriage cam and a needle that is not operated thereby. FIG. 8 shows the relationship between a needle 6 and the selection actuator 2. The reference numeral 7 stands for a needle jack, 8—a selector jack, 10—a selector; those components are parts of the needle 6. The reference numeral 12 stands for a bat provided at the selector 10. The selector 10 is impelled upward as shown in FIG. 8 by an elastic leg 14, and an armature 16 of the selector 10 is selected by the selection actuator 2. The needle 6 is accommodated in a needle bed 18, the carriage 20 moves with respect to the needle bed 18, and the selection actuator 2 is attached to the carriage 20. The reference numerals 21, 22 stand for bands provided at the needle bed 18. The needle 6 is impelled upward as shown in FIG. 8 by the elastic leg 14, magnetically attracted to the working portion 4 of the selection actuator 2, and from this state the needle that is not anymore attracted by the selection actuator 2 is operated by the cam of the carriage 20. For example, in the case of a flat knitting machine, the needle is selected at three stages: knitting, tucking, and missing.

Returning to FIG. 1, the working portion 4 of the selection actuator 2 has two selection units: a first selection unit 30 and a second selection unit 32, and a first control magnetic pole 33 and a second control magnetic pole 34 are provided parallel to each other with a short spacing therebetween at each of the selection units 30, 32. The first control magnetic pole 33 is controlled by a coil 35, and the second control magnetic pole 34 is controlled by a coil 36. A nonmagnetic body 38 such as a thin sheet of copper or an aluminum sheet is provided to isolate the first control magnetic pole 33 and second control magnetic pole 34 magnetically from each other and to isolate the two control magnetic poles 33, 34 magnetically from permanent magnets 40-43 or magnetic bodies 44-49 located around them. The nonmagnetic body 38 also may be air or other materials. The permanent magnets 40, 41 are disposed on both sides of the magnetic body 45 so that the magnetic poles thereof have mutually opposite orientations, for example, so that S poles face each other. The permanent magnets 42, 43 are also disposed so that the magnetic poles thereof have mutually opposite orientation, for example, so that N poles face each other on both sides of the magnetic body 48. In the present embodiment, magnetic poles of the permanent magnets 40, 41 and permanent magnets 42, 43 have opposite orientations. Appropriate ferromagnetic materials are used for the magnetic bodies 44-49.

Figure 1:
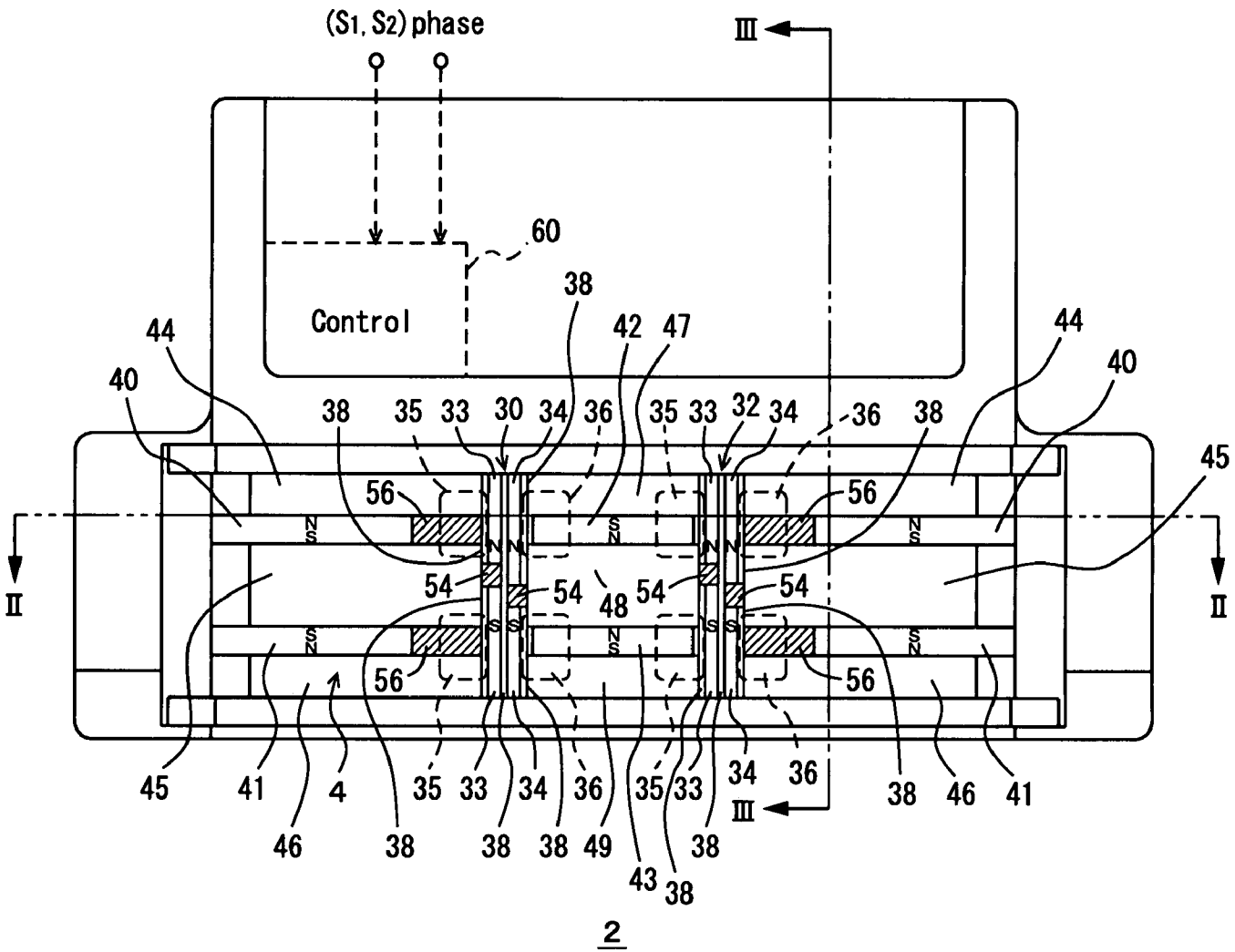
FIG. 1 is a plan view of a selection actuator of the embodiment.
Figure 2:
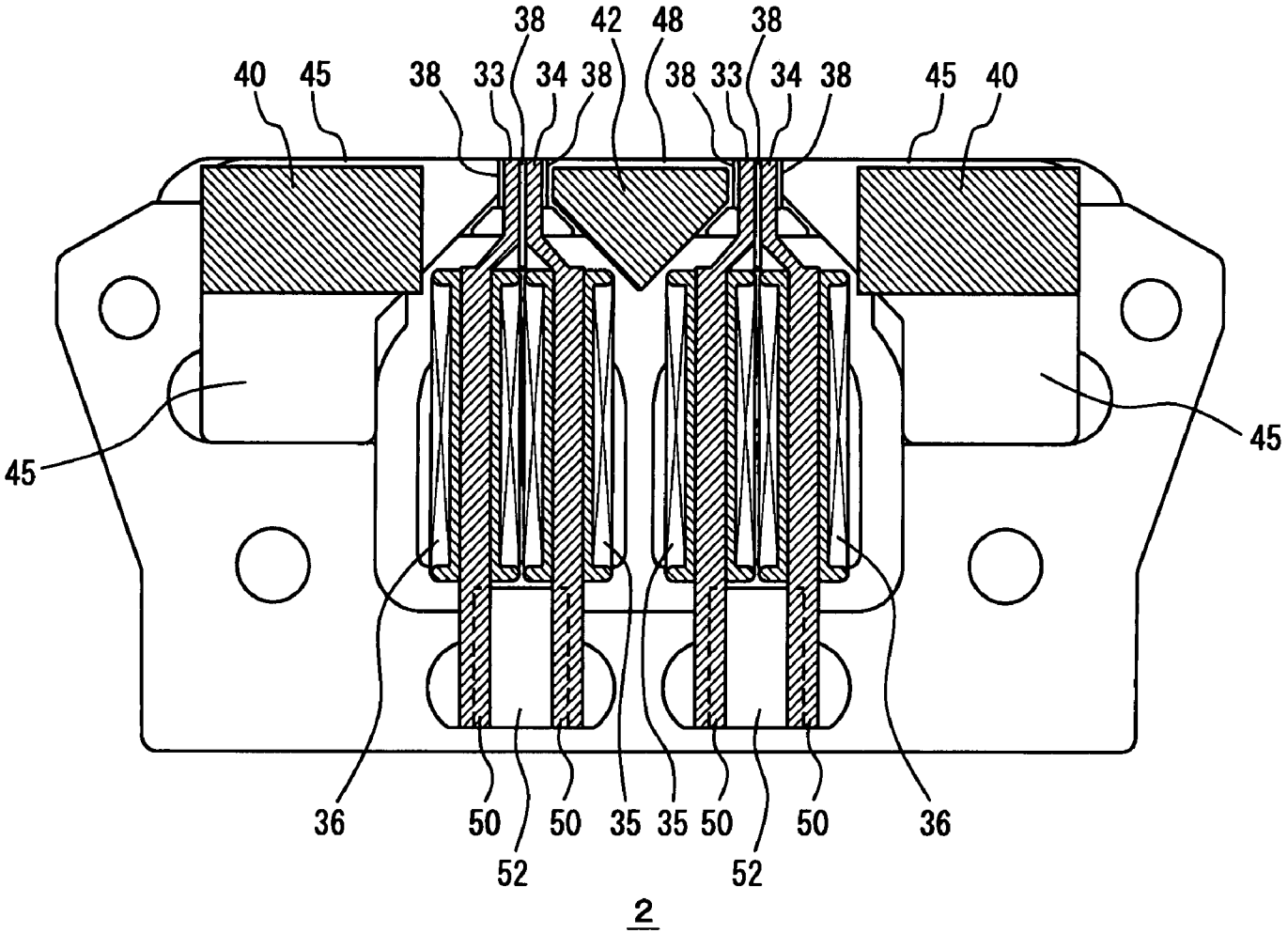
FIG. 2 is a cross-sectional view in the II-II direction in FIG. 1.
Figure 3:
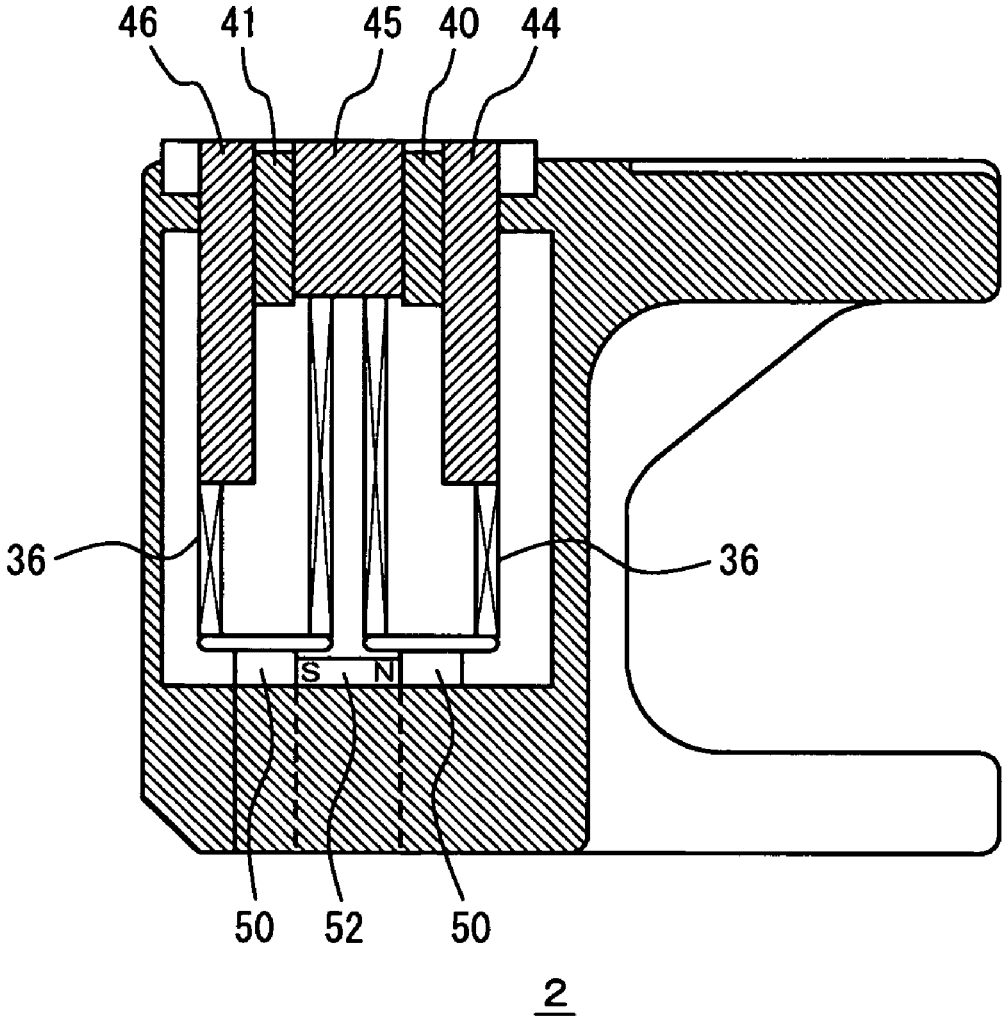
FIG. 3 is a cross-sectional view in the III-III direction in FIG. 1.

The reference numeral 50 in FIG. 2 stand for magnetic cores that pass through the coils 35, 36. The upper sections of the magnetic cores are bent along the longitudinal direction of the selection actuator 2 to reduce the spacing between the magnetic cores 50, 50 and obtain the first control magnetic pole 33 and second control magnetic pole 34. The magnetic cores 50 are made, for example, from oriented silicon steel strips. The magnetic core 50 is obtained, for example by laminating four oriented silicon steel strips with a thickness of approximately 0.25 mm, the number of steel strips is decreased from four to two in an intermediate portion, and the section of magnetic cores that are laminates of two oriented silicon steel strips serve as the first control magnetic pole 33 and second control magnetic pole 34. As shown in FIG. 1, etc., the width of the control magnetic poles 33, 34 in the short-side direction of the selection actuator 2 is larger than the width of the coils 35, 36. Therefore, the thickness of the magnetic core 50 decreases from that of four strips in the portion of coils 35, 36 to that of two strips in the portion of the control magnetic poles 33, 34, and the width on one of them in the short-side direction of the selection actuator 2 increases in the position of the control magnetic poles 33, 34 over that inside the coils 35, 36. The oriented silicon steel strips are used because they have a high saturation magnetization and, therefore, the selector can be effectively attracted and released even with thin magnetic cores or control magnetic poles, and also because the amount of heat generated therein is small due to a small iron loss. A permanent magnet 52 is located below the magnetic cores 50, 50. In the present embodiment a common permanent magnet 52 is provided for a pair of magnetic cores 50, 50, but a permanent magnet may be also provided for each magnetic core 50.

Returning to FIG. 1, gaps 54 are present between the N pole and S pole of the first control magnetic pole 33 and between the N pole and S pole of the second control magnetic pole 34, and the positions of the gaps are shifted with respect to each other along the short-side direction of the selection actuator 2. Furthermore, gaps 56 are also present between the control magnetic poles 33, 34 and permanent magnets 40, 41. The gaps 54, 56 are filled, for example, with a plastic.

The reference numeral 60 in FIG. 1 stands for a control unit of the selection actuator 2 that independently controls a total of four control magnetic poles of the two control magnetic poles 33, 34 of each selection unit 30, 32. The selection unit 60 inputs a selection signal s1 that selects whether to select a selector that will arrive at the first selection unit 30 and a selection signal s2 for a selector that will arrive at the second selection unit 32, e.g., from a control unit of the flat knitting machine body (not shown in the figure). The selectors are arranged with a constant pitch in the needle bed, and the phase of the selection units 30, 32 with respect to the arrangement pitch of the selector is necessary for the control. Accordingly, the signal PHASE representing the phase is inputted in the control unit 60. The control unit 60 finds data that determine whether or not to select the position of the selectors with respect to each control magnetic pole 33, 34 from the signals s1, s2, PHASE and selects a selector by applying the predetermined pulse waveform to the coils 35, 36 of the control magnetic poles.

In the present embodiment, each selector is attracted by the magnetic bodies 44-46. When the coils 35, 36 of the control magnetic poles 33, 34 are not energized, the attraction is maintained by the magnetic force from the permanent magnet 52 in the bottom sections of the control magnetic poles 33, 34, and when the coils 35, 36 are energized, the selection is made by canceling the attraction force from the permanent magnet 52. The type in which the attraction is canceled by energizing the coils is called an energizing release type, and in the present embodiment the selection actuator 2 of a energizing release type is described, but the attraction of the selector may be also maintained by passing an electric current to the coils 35, 36, without providing the permanent magnet 52. Such type is called an energizing attraction type.

In a flat knitting machine, the carriage moves with respect to the needle bed, but for convenience of explanation, the flat knitting machine will be explained below as if the selector moves with respect to the selection actuator 2. The selector that moves, for example, from left to right, as shown in FIG. 1, with respect to the selection actuator 2 is selected for knitting or other stages with the first selection unit 30, and the selector that has not been selected with the first selection unit 30 is selected for tucking and missing with the second selection unit 32. Furthermore, in the present embodiment the relationship between the selectors and control magnetic poles is represented for the upstream/downstream side, but when the selector moves from right to left, rather than from left to right, as shown in the figure, the upstream/downstream relationship is inverted.

Figure 4:
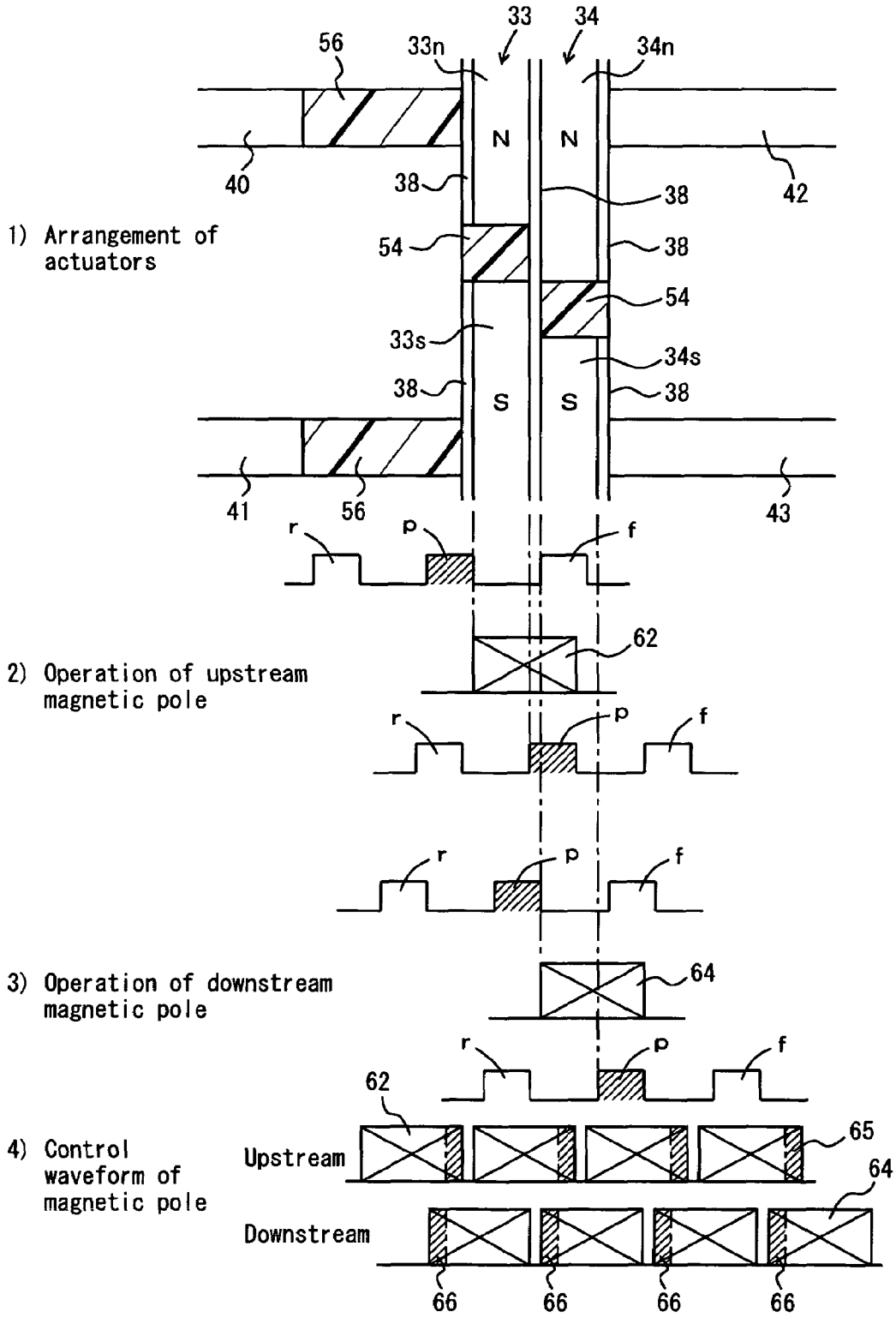
FIG. 4 are waveform diagrams illustrating the control waveforms of upstream control magnetic poles and downstream control magnetic poles related to the selector position in the embodiment, FIG. 4(1) showing the arrangement of selection actuator, FIG. 4(2) showing the operation of the upstream control magnetic pole, FIG. 4(3) showing the operation of the downstream control magnetic pole, and FIG. 4(4) showing the control waveforms of upstream and downstream magnetic poles.

FIG. 4 shows an operation waveform of a control magnetic pole with respect to the mode where a selector is selected and released. FIG. 4(1) shows the arrangement of control magnetic poles 33, 34, FIG. 4(2) shows the operation waveform of the upstream control magnetic pole 33 with respect to a selector p, FIG. 4(3) shows the operation waveform of the downstream control magnetic pole 34, and FIG. 4(4) shows the operation waveform of sections consisting of four selectors. In the present embodiment, a 25 G flat knitting machine is assumed, this machine having a selector pitch of approximately 1 mm, a thickness of the control magnetic poles 33, 34 of 0.5 mm each, and a thickness of the nonmagnetic body 38 of 0.1 mm. Furthermore, the selector thickness is taken, for example, as 0.4 mm. In the explanation below, the N pole of the control magnetic pole is assigned with symbol n, and the S pole is assigned with symbol s. A selector serving as an object that will or will not be selected is denoted by p, the previous selector is denoted by f, and the following selector is denoted by r. The operation of the control magnetic pole is identical for the first selection unit 30 and second selection unit 32. In the first control magnetic pole 33, where the selector p reaches the predetermined position along the longitudinal direction of the actuator 2 with respect to the control magnetic pole 33, if for example the selector p becomes superimposed on the control magnetic pole 33, a release pulse is supplied, and where the selector p reaches the second predetermined position with respect to the control magnetic pole 33, if the superposition of the two is canceled, the release pulse is turned off. Likewise, in the position where the superposition of the second control magnetic pole 34 and selector p is started (an example of the first predetermined position), the application of the release pulse is started, and in the position where the superposition disappears (an example of the second predetermined position) the pulse is canceled.

FIG. 4(4) shows an upstream selection width 62 and a downstream selection width 64. The reference numerals 65, 66 stand for overlapping portions of the selection widths 62, 64. It is also possible that a selection pulse is not applied in the overlapping portions 65, 66 and that the overlapping portions 65, 66 are not provided. The selection width as referred to herein means a width for applying a pulse to a coil to select each individual selector, and if the selection widths 62, 64 overlap, a selection width of a total value of 1.5 mm is obtained for selectors arranged with a pitch of approximately 1 mm. The total selection width changes if the timing of turning the pulse ON/OFF is changed, but a selection width equal to or larger than the pitch of the selector is easy to obtain. Therefore, the reliable selection is possible even if the arrangement pitch of selectors is small, and a selector can be reliably selected, for example, at a gauge of about 20-30 G.

Figure 5:
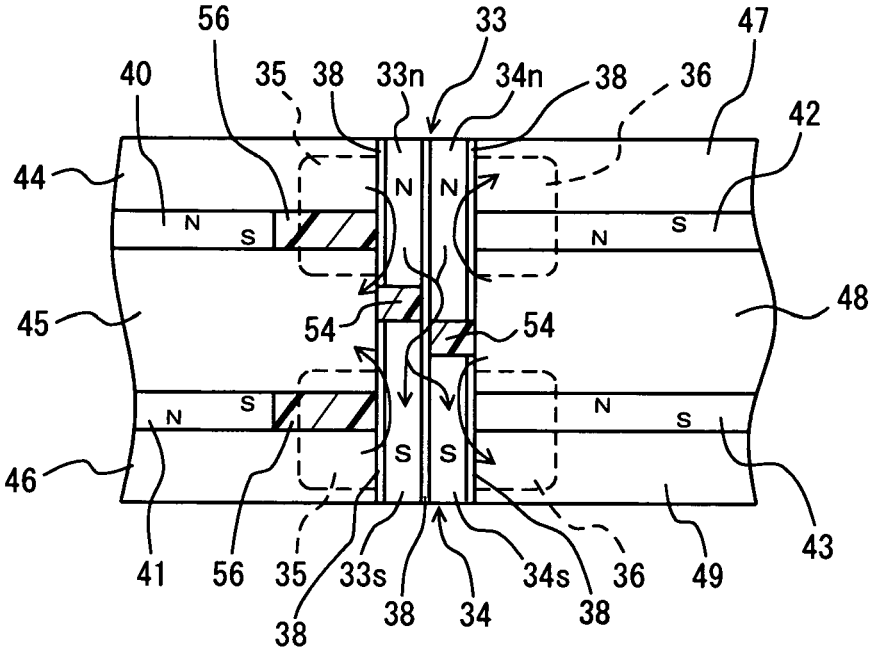
FIG. 5 shows schematically the configuration of a magnetic circuit in the control magnetic poles of the embodiment, more particularly shows the flow of a magnetic flux using the neighboring control magnetic poles.

The leakage magnetic flux treatment is shown in FIG. 5 and FIG. 6. If the leakage magnetic flux from the permanent magnets 40-43 reaches the surface of the control magnetic poles 33, 34 on the selector side, the leakage magnetic flux affects the selection of selectors. For this reason, the control magnetic poles 33, 34 are shielded from the side of the fixed magnetic poles with a nonmagnetic body 38. Furthermore, because the leakage magnetic flux that passed through the nonmagnetic body flows parallel to the main surface of the nonmagnetic body 38 inside the control magnetic poles 33, 34, it can be prevented from reaching the surface of the control magnetic poles 33, 34 on the selector side.

A gap 54 is present between the control magnetic pole 33*n* and the like and the control magnetic pole 33*s* and the like. Due to the presence of the gap 54, magnetic flux can flow from the control magnetic pole 33*n* and the like to the selector 10 and return to the control magnetic pole 33*s* and the like. However, because of the gap 54, a magnetic resistance between the control magnetic pole 33*n* and the like and the control magnetic pole 33*s* and the like varies depending on whether or not the selector has been attracted. In this state, as shown in FIG. 6, if the selector 10 is attracted, the magnetic flux flows inside the selector 10, but if the selector 10 is released, the magnetic flux is prevented from flowing and magnetic resistance increases. The magnetic flux that has nowhere to go leaks to the neighboring control magnetic poles 34*n*, 34*s*.

In the present embodiment, the gap 54 is shifted in the short-side direction of the selector in the first control magnetic pole 33 and second control magnetic pole 34 and a bypass path for the magnetic flux shown by arrows in FIG. 5 is formed. This bypass path spreads in the depth direction as shown in FIG. 5 (direction perpendicular to the paper sheet), and the leakage magnetic flux toward the surface of the control magnetic poles 33, 34 on the selector side can be decreased.

FIG. 7 illustrates processing relating to residual magnetization of the selector 10. If a tool steel having magnetic properties is used for the selector 10, e.g., to provide for durability, and the polarity of permanent magnets 40, 41 and permanent magnets 42, 43 is the same, the selectors are exposed to a magnetic field of the same orientation at all times above the fixed magnetic poles, whereby a residual magnetization can occur. If the residual magnetization occurs, the release characteristic in the selection units 30, 32 is degraded. Accordingly, the polarities of the permanent magnets 40, 41 and permanent magnets 42, 43 are inverted to prevent the accumulation of residual magnetization.

Figure 9:
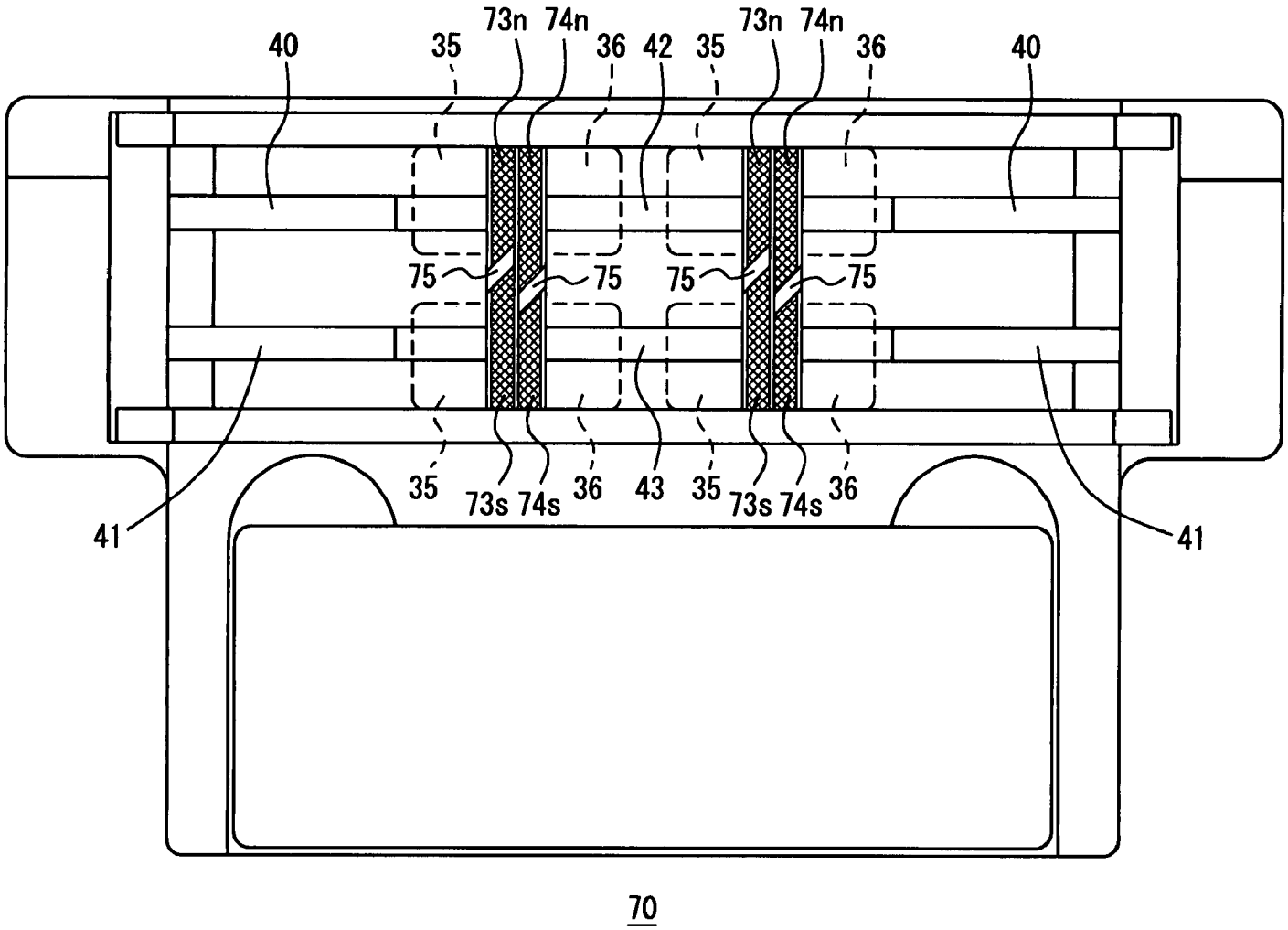
FIG. 9 is a plan view of a selection actuator of the first modification example.
Figure 10:
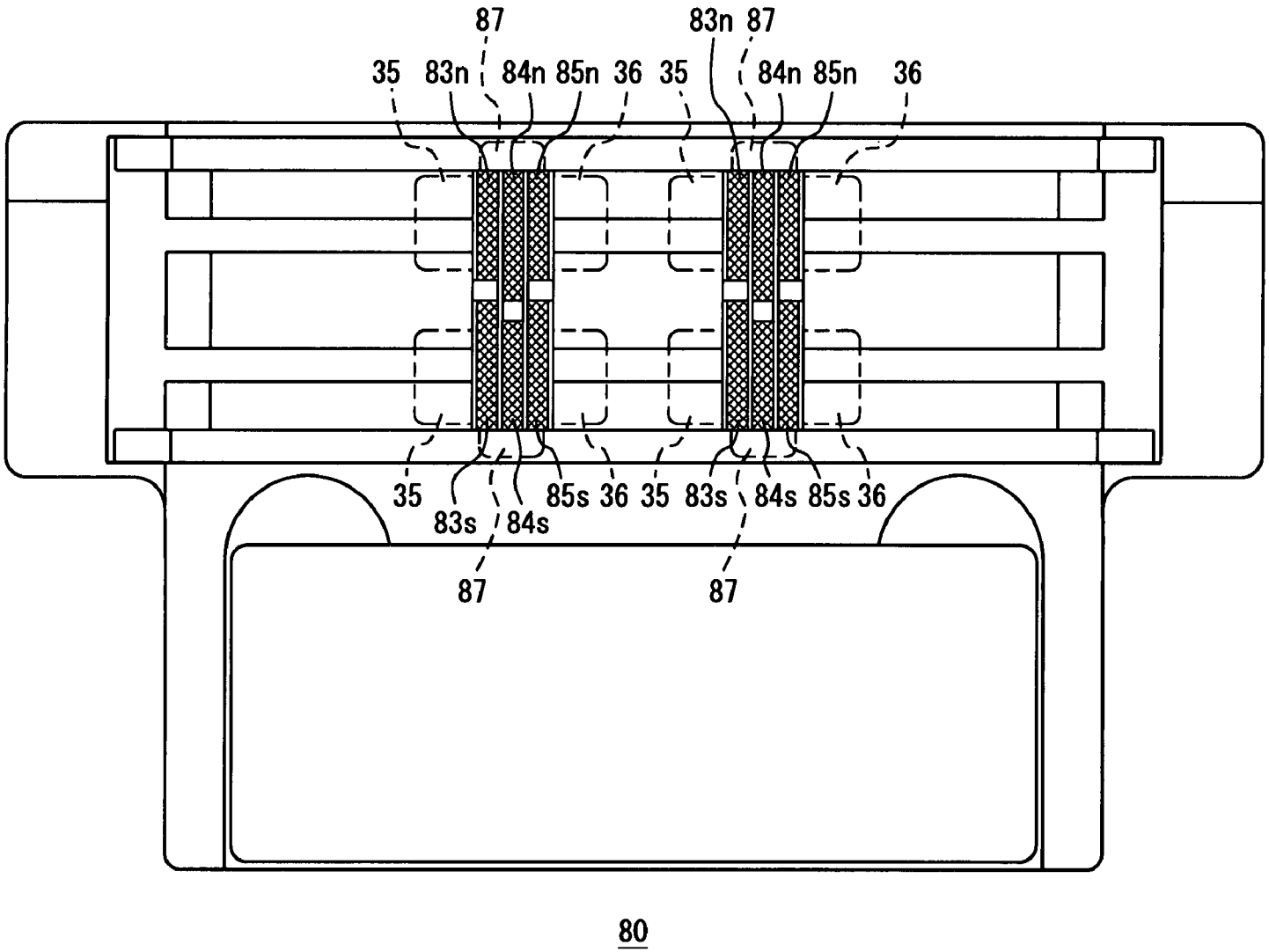
FIG. 10 is a plan view of a selection actuator of the second modification example.
Figure 11:
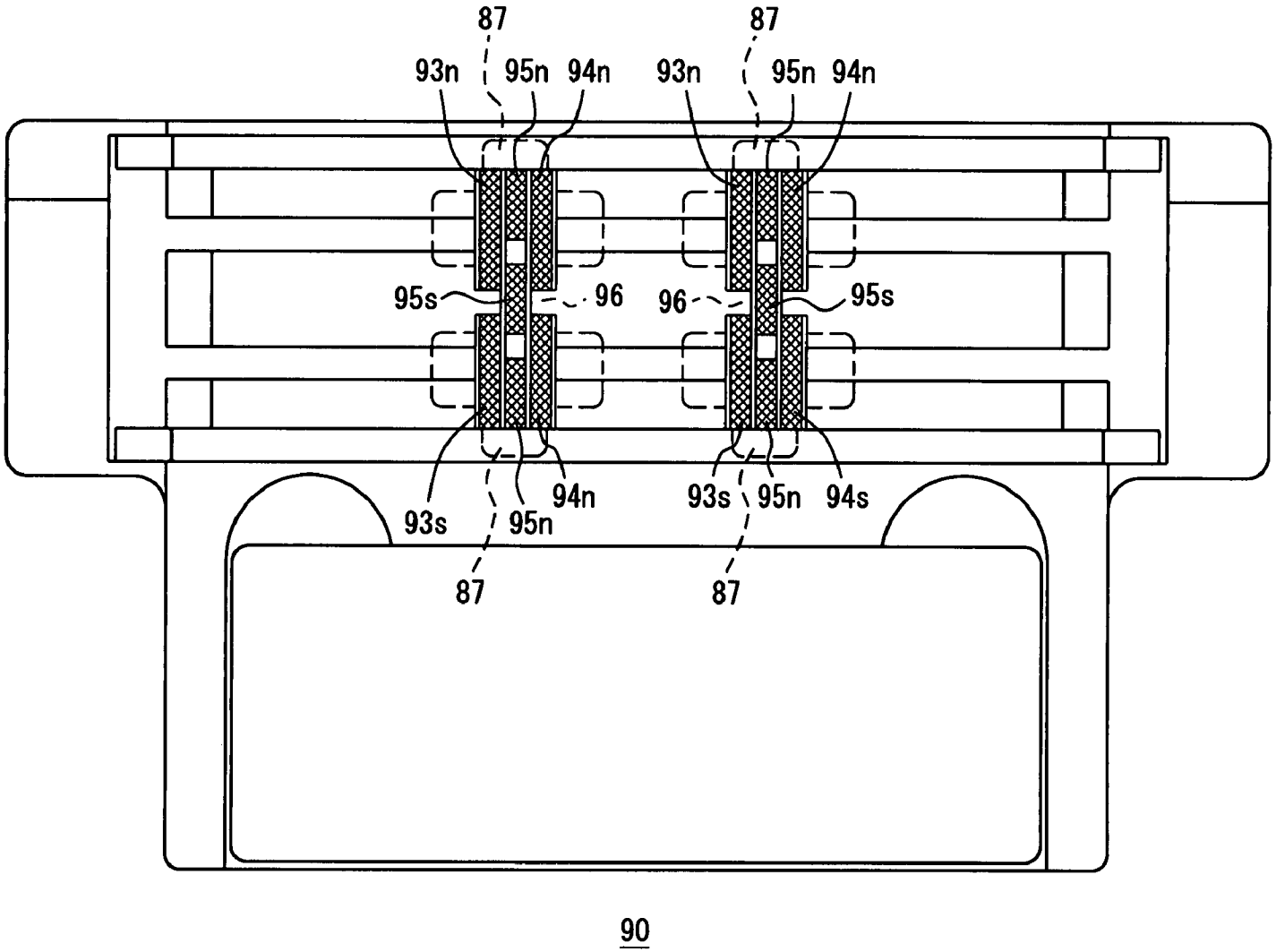
FIG. 11 is a plan view of a selection actuator of the third modification example.

Selection actuators 70, 80, 90 of modification examples are shown in FIGS. 9-11. In FIG. 9, the reference symbols 73*n*-74*s* stand for new control magnetic poles, the gap 75 is cut obliquely, and the flow of magnetic flux from the control magnetic pole 74*n* to the control magnetic pole 73*s* is facilitated. Other features are identical to those of the selection actuator 2 of the embodiment.

In a selection actuator 80 shown in FIG. 10, three control magnetic poles 83*n*-85*s* are provided in the upstream, midstream, and downstream zones. Further, a new coil 87 is provided for the control magnetic poles 84*n*, 84*s*. Other features are identical to those of the selection actuator 2 of the embodiment.

In a selection actuator 90 of FIG. 11, control magnetic poles 93*n*-95*s* are provided and the difference between this selection actuator and the selection actuator 80 shown in FIG. 10 is that two control magnetic poles 95*n* are provided for each set. Accordingly, a coil 96 is additionally provided. Other features are identical to those of the selection actuator 80 shown in FIG. 10.

The following effects are obtained in the embodiment.

(1) Reliable selection is possible even with a fine gauge of about 20-30 G.

(2) A long time can be used for selecting each selector. Therefore, the selection is reliable.

(3) The variation of coil current depending on whether or not the selector attraction is present, this current being necessary to demagnetize the control magnetic poles, can be dealt with by shifting the position of the gap 54 in the short-side direction.

(4) Using an oriented silicon steel strip for a magnetic core makes it possible to prevent saturation and decrease iron loss.

(5) By disposing magnetic cores linearly, bending the upper sections thereof, and aligning with a short spacing, the control magnetic poles and coils can be accommodated inside the selection actuator.

(6) Residual magnetization can be prevented from accumulating in the selector.

(7) The leakage magnetic flux between the permanent magnets can be prevented with the nonmagnetic body 38 and control magnetic poles 33, 34 from affecting the selection.

The invention claimed is:

1. A selection actuator comprising a selection unit in which a plurality of control magnetic poles controlled with coils are disposed close to each other on an upstream side and a downstream side via a non-magnetic body and select a knitting member of a knitting machine with the control magnetic poles of said selection unit, wherein control means is provided for operating the control magnetic pole on the upstream side of the selection unit based on a position of the knitting member to be selected with respect to the control magnetic pole on the upstream side and operating the control magnetic pole on the downstream side of the selection unit based on the position of the same knitting member with respect to the control magnetic pole on the downstream side, and the knitting member to be selected is selected with the operation of both the control magnetic poles on the upstream and downstream sides of the selection unit.

2. The selection actuator of claim 1, wherein a movement range of the knitting member, from a start of the operation of the control magnetic pole on the upstream side of the selection unit to an end of the operation of the control magnetic pole on the downstream side of the selection unit with respect to the knitting member to be selected, is not less than 100% of an arrangement pitch of knitting members in the knitting machine.

3. The selection actuator of claim 1, wherein a magnetic core of each of the control magnetic poles on the upstream and downstream sides has a linear shape, the coil is wound about the magnetic core, and an upper section of the magnetic core is bent along a longitudinal direction of the selection actuator so that ends of the magnetic cores face each other via a short spacing and serve as the control magnetic poles on the upstream and downstream sides.

4. The selection actuator of claim 3, wherein the magnetic core comprises laminates of a plurality of oriented silicon steel strips, a thickness of the control magnetic pole is made less than a thickness of the magnetic core inside the coil by reducing a number of the laminates of the silicon steel strips in a portions of the control magnetic pole, and a width of the control magnetic pole in a short-side direction of the selection actuator is made larger than a width of the magnetic core inside the coil in the same direction.

5. The selection actuator of claim 1, wherein a gap is provided between a N pole and a S pole of each of the control magnetic poles, and a position of the gap is shifted along a short-side direction of the selection actuator with the control magnetic poles on the upstream and downstream sides.

6. The selection actuator of claim 1, wherein magnetic attraction of the knitting member with the control magnetic poles is canceled and the knitting member is released from the selection actuator by energizing the coils, left and right fixed magnetic poles are disposed on both outer sides of the selection actuator along a longitudinal direction of the selection actuator, and polarities of said left and right fixed magnetic poles are inverted with respect to each other.

7. The selection actuator of claim 2, wherein said control means starts the operation of the control magnetic pole on the upstream side in a position where the knitting member to be selected overlaps the control magnetic pole on the upstream side, ends the operation of the control magnetic pole on the downstream side in a position where the knitting member does not any more overlap the control magnetic pole on the downstream side, and uninterruptedly operates at least one of the control magnetic poles on the upstream and downstream sides from the operation start of the control magnetic pole on the upstream side to the operation end of the control magnetic pole on the downstream side.

8. The selection actuator of claim 7, wherein said control means ends the operation of the control magnetic pole on the upstream side in a position where the knitting member to be selected does not any more overlap the control magnetic pole on the upstream side, and starts the operation of the control magnetic pole on the downstream side in a position where the knitting member overlaps the control magnetic pole on the downstream side.

* * * * *